US006291147B1

(12) United States Patent
Nishio

(10) Patent No.: US 6,291,147 B1
(45) **Date of Patent: *Sep. 18, 2001**

(54) PROCESSING METHOD OF A SILVER HALIDE PHOTOGRAPHIC LIGHT-SENSITIVE MATERIAL

(75) Inventor: Shoji Nishio, Hino (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/255,649

(22) Filed: Feb. 22, 1999

(30) Foreign Application Priority Data

Feb. 25, 1998 (JP) ..... 10-043549

(51) Int. Cl.[7] ..... G03C 5/26
(52) U.S. Cl. ..... 430/429; 430/463; 430/943
(58) Field of Search ..... 430/418, 429, 430/453, 463, 943

(56) References Cited

U.S. PATENT DOCUMENTS

| | | | | |
|---|---|---|---|---|
| 2,179,242 | * | 11/1939 | Ham | 430/453 |
| 2,214,216 | * | 9/1940 | Webster | 430/453 |
| 3,997,347 | | 12/1976 | Parsonage | 430/398 |
| 5,278,033 | * | 1/1994 | Hagiwara et al. | 430/463 |
| 5,834,165 | * | 11/1998 | Hirabayashi | 430/463 |

FOREIGN PATENT DOCUMENTS

| | | | |
|---|---|---|---|
| 0823658 | | 11/1998 | (EP) . |
| 629608 | | 9/1949 | (GB) . |
| 63044654 | * | 2/1988 | (JP) . |
| 5088305 | * | 4/1993 | (JP) . |

OTHER PUBLICATIONS

European Search Report EP 99 30 1363.

CJ Battaglia et al Research Disclusure #187, pp. 625–626 XP002107726.

Anonymous: Hardening Fixers, Research Disclusre #167, p. 40 XP002107727.

Database WPI, Derwent Publications, XP002107729.

Robert T. Kreiman, Journal of Imaging Technology, vol. 10, #6, 12/84, pp. 242–243, XP002107728.

Database WPI, Derwent Publications, XP002107730.

* cited by examiner

*Primary Examiner*—Hoa Van Le
(74) *Attorney, Agent, or Firm*—Jordan B. Bierman; Bierman, Muserlian and Lucas

(57) ABSTRACT

A method for processing a silver halide photographic light-sensitive material comprising the following steps, a step for developing a silver halide photographic light-sensitive material in a developing solution, a step for fixing said silver halide photographic light-sensitive material which is developed in a fixing solution containing thiosulfate salt and alminum salt, a step for washing said silver halide photographic light-sensitive material which is fixed in a washing water, wherein said fixing solution does not substantially contain a boron compound but contains at least a precipitation restraining agent and said washing water contains oxidizing agent.

12 Claims, No Drawings

PROCESSING METHOD OF A SILVER HALIDE PHOTOGRAPHIC LIGHT-SENSITIVE MATERIAL

FIELD OF THE INVENTION

The present invention relates to a processing method of a silver halide photographic light-sensitive material (hereinafter referred to as a light-sensitive material) by using an automatic processor and specifically, to an extremely improved stain caused by fur and alga in washing tank, and to a processed light-sensitive material with extremely improved stain.

BACKGROUND OF THE INVENTION

Conventionally, a silver halide black-and-white photographic light-sensitive material is exposed imagewise, then processed in the processes including each process of development, fixation, washing and drying. In these processes, fixation process is carried out using fixing solution containing an aqueous soluble aluminum compound (so-called hardening fixer) so that the light-sensitive material is hardened, leading to shortening of processing time and improvement of transferring the light-sensitive material in an automatic processor.

In recent years, a decrease in the processing solution effuluent has been strongly demanded in terms of environmental protection. This is also preferred from the viewpoint of cost of processing solution effuluent. However, reducing fixing replenishment solution results in raising the concentration of silver and organic compounds which leach out of the light-sensitive material in the fixing solution. The raised concentration of silver and organic compounds in the fixing solution caused more increased stain in the tank of next washing process (silver sludge, fur, alga etc.), and this stain adheres to transferring roller in the washing tank and outlet roller of the washing tank, further to the surface of the processed light-sensitive material resulting in inferior photographic characteristics. Therefore, reducing fixing replenishment solution has faced limitation.

Hardening fixer containing an aqueous soluble aluminum compound produces an aqueous insoluble aluminum salt with increasing of pH. To prevent it, it is preferred to lower pH, but as fixer contains thiosulfate salt(s) as a major agent, it causes vulcanization of a major agent at low pH. For this reason, conventionally fixer is used in the pH range of 4.2 to 5.4, nevertheless in this pH range, it is impossible to prevent the formation of an aqueous insoluble aluminum compound. Especially, in reducing fixing replenishment solution, increased concentration of various salts induces easily the formation of aqueous solution insoluble alminum compound. To solve this problem, large amount of boron compound has been used. The boron compound is carried over to next washing tank by the light-sensitive material and tends to induce supernutrition, therefore the stain in the washing tank deteriorates more and more.

To meet this problem, purification agent MB-1 (produced by Konica Co., Ltd.) was in the market. However, it has been gradually impossible to completely prevent the stain in the washing tank in recent very low rate of fixing replenishment solution.

On the other hand, it is known that organic acid can be the alternative to the boron compound, for example, in stead of the boron compound, organic acids such as gluconic acid and glycollic acid are described in Research Disclosure (RD) 18728. Other alternatives are described in RD 16768, Japanese Patent Publication Open to Public Inspection (hereinafter referred to as JP-A) No. 63-284546.

SUMMARY OF THE INVENTION

Accordingly, in view of the foregoing, the present invention was accomplished. An object of the present invention is to provide a method in which a silver halide photographic light-sensitive material is fixed by reducing an extreme amount of fixing replenishment rate and is processed by reducing an extreme amount of stain in a washing tank of an automatic processor together with excellent maintenance.

DETAILED DESCRIPTION OF THE INVENTION

Above objects of the invention could be attained by the following methods.

1. A method for processing a silver halide photographic light-sensitive material comprising the following steps,
   - a step for developing an exposed silver halide photographic light-sensitive material in a developing solution,
   - a step for fixing said developed silver halide photographic light-sensitive material in a fixing solution containing thiosulfate salt and alminum salt,
   - a step for washing said fixed silver halide photographic light-sensitive material in a washing water, wherein said fixing solution does not substantially contain a boron compound but contains at least a precipitation restraining agent and said washing water contains an oxidizing agent.
2. The method for processing the silver halide photographic light-sensitive material of item 1, wherein said washing water is made by mixing a solution containing said oxidizing agent or a solid composition containing said oxidizing agent with water.
3. The method for processing the silver halide photographic light-sensitive material of item 2, wherein mixing said solution containing said oxidizing agent or said composition containing said oxidizing agent with water is carried out in a washing tank or a stabilizing tank of an automatic processor.
4. The method for processing the silver halide photographic light-sensitive material of item 1, wherein said precipitation restraining agent includes at least one of gluconic acid, glycollic acid, maleic acid, imidinoacetic acid, and 5-sulfosalicylic acid, and their derivatives, and their salts, and salts of their derivatives.
5. The method for processing the silver halide photographic light-sensitive material of item 1, wherein said oxidizing agent is hydrogen peroxide.
6. The method for processing the silver halide photographic light-sensitive material of item 1, wherein replenishing solution of said fixing solution is replenished in an amount of not more than 400 ml/m$^2$.
7. The method for processing the silver halide photographic light-sensitive material of item 1, wherein the replenishing solution of said fixing solution is prepared by dissolving a solid processing composition in water, comprising at least one part molded in a solid form containing a mixture of at least two components.
8. The method for processing the silver halide photographic light-sensitive material of item 1, wherein said washing water contains bactericide.
9. The method for processing the silver halide photographic light-sensitive material of item 1, wherein said washing water contains a compound represented by the following formula (1);

Formula (1)

$$HO—(C_2H_4O)n—(C_3H_6O)m—(C_2H_4O)l—H$$

[in the formula, n, m and l represent each a positive integer].

10. The method for processing the silver halide photographic light-sensitive material of claim 1, wherein said washing water contains at least one of salicylic acid, salicylic acid salt, derivative of salicylic acid and salt of the derivative of salicylic acid.

11. The method for processing the silver halide photographic light-sensitive material of item 1, wherein said washing water contains silver sludge preventing compound represented by the following formula (2);

Formula (2)

$$Z^1—SM^1$$

[In the formula, $Z^1$ represents an alkyl group, an aromatic group or a heterocyclic group, each of which has a substituent having a group selected from the group consisting of a hydroxyl group, an $—SO_3M^2$ group, a $—COOM^2$ group, (in which $M^2$ represents a hydrogen atom, an alkali metal atom, or a substituted and unsubstituted ammonium ion), a substituted and unsubstituted amino group, and a substituted and unsubstituted ammonio group, or a substituent having at least one selected from the above mentioned group; Ml represents a hydrogen atom, an alkali metal atom or a substituted or unsubstituted amidino group, (which may form a salt with a hydrogen halide or a sulfonic acid)].

12. The method for processing the silver halide photographic light-sensitive material of item 1, wherein said fixing solution contains chelating agent of which chelate stabilization constant with calcium ion is 0.8 to 5.0.

A processing method in which a silver halide photographic light-sensitive material, which is exposed imagewise and developed, is fixed in a fixing solution containing a thiosufate salt and an aluminium salt followed by washing said silver halide photographic light-sensitive material in a washing water containing an oxidizing agent, characterized in that said fixing solution does not substantially contain a boron compound but contains at least a precipitation restraining agent, and a condensed solution or a solid processing composition containing an oxidizing agent is supplied while said condensed solution or solid processing composition containing an oxidizing agent being mixed with water in washing tank after the fixing process by an automatic processor.

The inventors have investigated a system of fixing and washing processes to reduce stain in a washing tank, and surprisingly could find out that as a alternative of a boron compound, by using specified precipitation restraining agents, not only the occurrence of aqueous insoluble aluminum compounds was prevented but also the stain in a washing tank was overwhelmingly improved.

Next, the invention will be explained in detail.

In this invention, in the processing system using so-called hardening fixer, the system features that fixing solution does not substantially contain a boron compound, but contains at least a precipitation restraining agent, and an oxidizing agent. Hereon, the terms "does not substantially contain a boron compound" means the concentration of a boron compound in a working solution is not more than 0.04 mole/l.

The precipitation restraining agent according to the invention is described in RD 18728 and preferable one is an organic acid described in JP-A No. 8-29929. As especially preferable compounds, are cited gluconic acid, glycollic acid, maleic acid, imidinoacetic acid, 5-sulfosalicylic acid, and their derivatives and their salts. Namely, as the precipitation restraining agent, especially preferable compound is one selected from gluconic acid, glycollic acid, maleic acid, imidinoacetic acid, 5-sulfosalicylic acid, and gluconic acid salt, glycollic acid salt, maleic acid salt, imidinoacetic acid salt, 5-sulfosalicylic acid salt, and gluconic acid derivative, glycollic acid derivative, maleic acid derivative, imidinoacetic acid derivative, 5-sulfosalicylic acid derivative, and salt of gluconic acid derivative, salt of glycollic acid derivative, salt of maleic acid derivative, salt of imidinoacetic acid derivative, salt of 5-sulfosalicylic acid derivative. The most preferable ones are gluconic acid and imidinoacetic acid, and their derivatives and their salts.

Adding amount of these compounds is 0.005 to 0.2 mole/l in a working solution of one part type hardening fixer which does not substantially contain boron compound, preferably 0.005 to 0.1 mole/l. These compounds can be used singly or in combination of two kinds or more. Furthermore, it is preferable that these compounds are used in combination with organic acids such as tartaric acid, citric acid, succinic acid, salicylic acid, ascorbic acid and erythorbic acid etc., and aminopolycarboxylic acid such as glycine, ethylenediaminetetraacetic acid, diethylenetriaminepentaacetic acid and nitrilotriacetic acid, and sugar derivatives.

As an oxidizing agent used in the invention, is cited metallic or non-metallic oxide, oxygen acid or its salt, peroxide, and a compound including organic acid. From the viewpoint of discharging from draining pipe, as the aforesaid oxygen acid, sulfuric acid, nitrous acid, nitric acid and hypochlorous acid etc. are preferable, as the aforesaid peroxide, hydrogen peroxide and Fenton's reagent are especially preferable. It is not preferred that these oxidizing agents are once diluted with water and then replenished in washing tank because more space to place a diluting tank is needed. Therefore, it is preferred to replenish a solution or a solid composition containing the oxidizing agent in washing tank or stabilizing processing tank, then dilute the solution or the solid composition. Replenishment timing accords with constant replenishment with every unit time or with every processed amount of the light-sensitive material by detecting the processed amount. With respect to replenishing methods, there are such methods as mentioned below, (i) a method of supplying the oxidizing agent with every fixed time or with every fixed amount of processed light-sensitive material by keeping supply of water constantly, (ii) a method of supplying water and the oxidizing agent with every fixed time or with every fixed amount of processed light-sensitive material, (iii) a method of supplying water and the oxidizing agent with every fixed time or with every fixed amount of processed light-sensitive material after discharging all amount of washing water in washing tank. Adding amount of the oxidizing agent is preferably 0.5 to 10 mole equivalent to the amount of thiosulfate salt carried over by the light-sensitive material, more preferably 0.5 to 3 mole equivalent. In cases where hydrogen peroxide is used as the oxidizing agent, the concentration of hydrogen peroxide dissolved in water is preferably not more than 6%.

In this invention, the oxidizing agent kit is used in combination with preserving agent and bactericide so that the oxidizing agent functions more effectively.

As examples of the preserving agents used in the invention, are cited phosphoric acid, barbituric acid, urea, acetanilide, oxyquinoline, salicylic acid, quinolic acid, and their derivatives and their salts.

As examples of the bactericides used in the invention which do not affect adverse effect on photographic characteristics, are cited thiazolylbenzimidazole derivative, isothiazolone derivative, chlorophenol derivative, bromophenol derivative, thiocyanic acid derivative, isothiane acid derivative, acid azide derivative, diazine derivative, triazine derivative, thiourea derivative, alkylguanidine derivative, quaternary ammonium salt, organic tin compound, organic zinc compound, cyclohexylphenol derivative, imidazole derivative, benzimidazole derivative, sulfamide derivative, active halogen compound such as sodium chlorinated isocyanuric acid, chelate compound, sulfite compound, and antibiotics such as anti-bacteria and anti-mould represented by penicillin. Other bactericides described in "Water Quality Criteria" written by L. E. West in Phot. Sci. and Eng., vol 9, No. 6; various bactericides described in JP-A Nos. 57-8542, 58-105145, 59-126533, 55-111942 and 57-157244; compounds described in [Boukin boubai no Kagaku] (Chemistry of antibact. and antifung.) written by Hiroshi Horiguchi, Sankyou Syuppan (1982), [Handbook of boukin boubai gijutu] (Technical handbook of antibact. and antifung.) edited by Japan antibact. and antifung. Society Gihoudo (1886), can be used.

The exemplified compounds are shown below, but is not limited thereto.

1. 5-chloro-2-methyl-4-isothiazoline-3-one
2. 2-(4-thiazolyl)-benzimidazole
3. Methyl isothianate
4. 3,5-dichloro-4'-fluoro-thiocarbanilide
5. 4-chloro-3,5-dimethylphenol
6. 2,4,6-trichlorophenol
7. Sodium dehydroacetic acid
8. Sulfanilamide
9. 3,4,5-tribromosalicylanilide
10. Potassium Sorbate
11. 1-bromo-3-chloro-5,5-dimethylhydantoin
12. Monochloroacetamide
13. Monobromoacetamide
14. Monoiodoacetamide
15. Benzimidazole
16. Cyclohexylphenol
17. 2-octyl-isotiazoline-3-one
18. Ethylenediaminetetraacetic acid
19. Nitrilo-N,N,N-trimethinephosphonic acid
20. 1-hydroxyethane-1,1-diphosphonic acid
21. Ethlenediamine-N,N,N',N'-tetramethylenephosphonic acid
22. Sodium chlorinated isocyanurate
23. 2-methyl-4-isothiazoline-3-one
24. 10,10'-oxybisphenoxy arsine
25. 1,2-benzisothiazoline-3-one The synthesizing methods and applied examples in other field of these exemplified compounds are described in U.S. Pat. Nos. 2,767,172, 2,767,173, 2,767,174, 2,870,015, U.K. Patent No. 848,130, France Patent No. 1,555,416. Some of them are in the market and trade names such as Predentol ON, Permachem PD, Topside 800, Topside EG5, Topside 300, Topside 600 (all of them are produced by Permachem Asia Co., Ltd.), Fineside J-700 (produced by Tokyo Finechemical Co., Ltd.), Prozel GXL (produced by I.C.I. Co., Ltd) are available.

In cases where the above mentioned bactericides are supplied in washing water, adding amount is preferably 0.01 to 50 g/l, more preferably 0.05 to 20 g/l.

A compound containing polyalkyleneoxide chain represented by the general formula (1) used in the invention is the compound obtained from addition polymerization of propyleneglycol as a hydrophobic group and ethyleneoxide. In this invention the compound having an average molecular weight of 2000 to 8500 is preferable, and content of molecular weight of polypropyleneglycol (PPG) in this compound is preferably 1400 to 2400. Wt. % of ethyleneoxide in the total weight of the molecule is preferably 40 to 85%. Especially, in the formula (1), n+1 is preferably about 150, m is preferably about 30. As the compound which meets these criteria, for example, non-ionic surfactant of trade name [pluronic series] produced by Asahi Denka Co., Ltd. is usable, and exemplified surfactants listed below are preferable.

TABLE 1

| Compound No. | Trade name | Average molecular weight | PPG molecular weight | Ethyleneoxide in total molecule (Wt %) |
|---|---|---|---|---|
| 1 | Pluronic L44 | 2,200 | 1,200 | 40 |
| 2 | Pluronic L62 | 2,500 | 1,750 | 20 |
| 3 | Pluronic L64 | 2,900 | 1,750 | 40 |
| 4 | Pluronic L68 | 8,350 | 1,750 | 80 |
| 5 | Pluronic F68LF | 7,700 | 1,750 | 80 |

Adding amount of the compound containing polyalkyleneoxide chain mentioned above is 1 to 1000 ppm to washing water, preferably 10 to 100 ppm, and in the case of using a purification agent, 0.01 to 10% to the oxidizing agent, preferably 0.1 to 5%.

The washing water according to the invention preferably contains the compound represented by the following formula (2).

Formula (2)

$$Z^1—SM^1$$

In the formula, $Z^1$ represents an alkyl group, an aromatic group or a heterocyclic group, each of which has a substituent having a group selected from the group consisting of a hydroxyl group, an —$SO_3M^2$ group, a —$COOM^2$ group, (in which M represents a hydrogen atom, an alkali metal atom, or a substituted and unsubstituted ammonium ion), a substituted and unsubstituted amino group, and a substituted and unsubstituted ammonio group, or a substituent having at least one selected from the above mentioned group; $M^1$ represents a hydrogen atom, an alkali metal atom or a substituted or unsubstituted amidino group, (which may form a salt with a hydrogen halide or a sulfonic acid).

In Formula (2), the alkyl group represented by $Z^1$ is preferably a straight- or branched-chain alkyl group having 1 to 30 carbon atoms, particularly 2 to 20 carbon atoms, and the alkyl group may have a substituent furthermore the above-mentioned substituent. The aromatic group represented by $Z^1$ is preferably a single ring or condensed ring aromatic group having 6 to 32 carbon atoms, and the aromatic group may have a substituent furthermore the above-mentioned substituent. The heterocyclic group represented by $Z^1$ is preferably a single ring or condensed ring heterocyclic group having 1 to 32 carbon atoms, namely a 5- or 6-membered ring including 1 to 6 hetero-atoms in a ring independently selected from nitrogen atom, oxygen atom and sulfur atom therein, and the heterocyclic group may have a substituent furthermore the above-mentioned substituent. When the heterocyclic group is a tetrazole ring, the tetrazole ring does not have a substituted or unsubstituted naphthyl group as the substituent. Among the compounds represented by Formula (2), a compound in which $Z^1$ is heterocyclic group having two or more nitrogen atoms, is preferred.

In the formula, $Z^1$ is substituted with at least one group selected from a hydroxyl group, an —$SO_3M$ group, a —COOM group, (in which M represents a hydrogen atom, an alkali metal atom, or a substituted and unsubstituted ammonium ion), a substituted and unsubstituted amino group, and a substituted and unsubstituted ammonio group, or a substituent having at least one selected from the above mentioned groups; $M^1$ represents a hydrogen atom, an alkali metal atom or a substituted or unsubstituted amidino group, (which may form a salt with a hydrogen halide or a sulfonic acid). The ammonio group is preferable an ammonio group having not more than 20 carbon atoms, and the substituent thereof is a substituted or unsubstituted straight-chain, branched-chain or cyclic alkyl group (such as methyl group, ethyl group, benzyl group, ethoxypropyl group or cyclohexyl group), substituted or unsubstituted phenyl group or a naphthyl group.

Among compounds represented by Formula (2), ones represented by Formula (2-a) are preferable.

Formula (2-a)

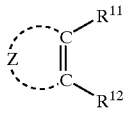

In the formula, Z represents a group of atoms necessary to form an unsaturated 5-membered heterocyclic group or an unsaturated 6-membered heterocyclic group each having a nitrogen atom (such as a pyrrole, an imidazole, a pyrazole, a pyrimidine, a pyridazine or a pyrazine). $R^{11}$ and $R^{12}$ are each a hydrogen atom, an —$SM^1$ group, a halogen atom, an alkyl group (including one having a substitute), an alkoxyl group (including one having a substitute), a hydroxyl group, a —COOM group, an —$SO_3M$ group, an alkenyl group (including one having a substitute), an amino group (including one having a substitute), a carbamoyl group (including one having a substitute), or a phenyl (including one having a substitute), which have at least one —SM group or a thione group, and a substituent selected from consisting of a hydroxyl group, a —COOM group, an —$SO_3M$ group, a substituted and unsubstituted amino group, and a substituted and unsubstituted ammonio group. In the formula, $R^{11}$ and $R^{12}$ can form a ring, thus formed ring is a 5- or 6-membered ring, preferably a nitrogen-containing ring. $M^1$ is the same as Ml defined in Formula (2). Z is preferably a group forming a heterocyclic group containing 2 or more nitrogen atoms, which may have a substituent furthermore the above-mentioned —SM group or thione group. As such the substituent, a halogen atom (fluorine, chlorine, bromine), a lower alkyl group (including one having a substituent, one having a 5 or less carbon atoms such as a methyl group or an ethyl group is preferred), a lower alkoxyl group (including one having a substituent, one having a 5 or less carbon atoms such as a methoxy group, an ethoxy group or a butoxy group is preferred), a lower alkenyl group (including one having a substituent, one having a 5 or less carbon atoms is preferred), a carbamoyl group and phenyl group are preferable. Moreover, a compound represented by the following Formulas A to E or F is preferred among the compounds represented by Formula (2-a).

Formula A

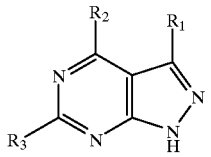

Formula B

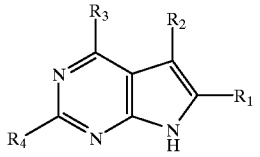

Formula C

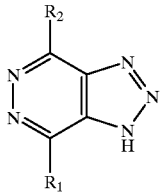

Formula D

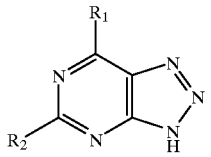

Formula E

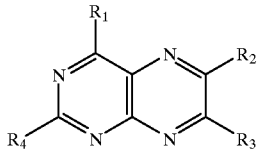

Formula F

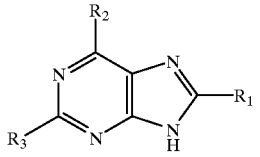

In the formulas, $R_1$, $R_2$, $R_3$ and $R_4$ are each a hydrogen atom, an —$SM_1$ group, a halogen atom, a lower alkyl group (including one having a substituent, and one having 5 or less carbon atoms such as a methyl group or an ethyl group is preferable), a lower alkoxy group (including one having a substituent, and one having 5 or less carbon atoms is preferable), a hydroxyl group, a —$COOM_2$ group, an —$SO_3M_3$ group, a lower alkenyl group (including one having a substituent, and one having 5 or less carbon atoms is preferable), an amino group, a carbamoyl group or a phenyl group, and at least one of them is an —$SM_1$ group. $M_1$, $M_2$ and $M_3$ are each a hydrogen atom, an alkali metal atom or an ammonium group, they may be the same or different. It is particularly preferred that the compound has a water-solubilizing group such as the hydroxyl group, the —$COOM_2$ group or the —$SO_3M_3$ as the substituent furthermore the —$SM_1$ group. The amino group represented by $R_1$, $R_2$, or $R_3$ is a substituted or unsubstituted amino group and the substituent is preferably a lower alkyl group. The ammonium is a substituted or unsubstituted ammonium group, preferably the unsubstituted ammonium group.

Although examples of the compound which prevent silver sludge represented by Formula (2) are shown below, the compound is not limited thereto.

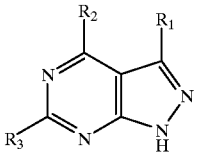

| | $R_1$ | $R_2$ | $R_3$ |
|---|---|---|---|
| 1 | H | H | SH |
| 2 | H | SH | H |
| 3 | $CH_3$ | H | SH |
| 4 | OH | H | SH |
| 5 | H | $NH_2$ | SH |
| 6 | Cl | SH | H |
| 7 | COOH | H | SH |

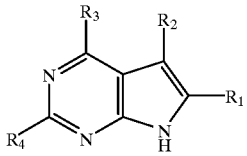

| | $R_1$ | $R_2$ | $R_3$ | $R_4$ |
|---|---|---|---|---|
| 8 | H | H | H | SH |
| 9 | Cl | H | H | SH |
| 10 | SH | H | H | H |
| 11 | $nC_5H_{11}$ | H | H | SH |
| 12 | OH | H | H | SH |
| 13 | H | H | OH | SH |
| 14 | SH | H | SH | H |

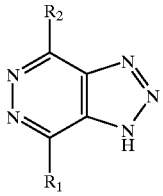

| | $R_1$ | $R_2$ |
|---|---|---|
| 15 | SH | H |
| 16 | SH | SH |
| 17 | SH | COOH |
| 18 | SH | $SO_3H$ |
| 19 | SH | OH |

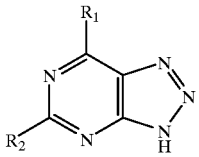

| | $R_1$ | $R_2$ |
|---|---|---|
| 20 | SH | H |
| 21 | SH | SH |
| 22 | SH | COOH |
| 23 | SH | $SO_3H$ |
| 24 | SH | OH |

-continued

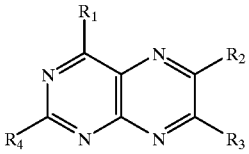

| | $R_1$ | $R_2$ | $R_3$ | $R_4$ |
|---|---|---|---|---|
| 25 | H | H | H | SH |
| 26 | H | H | SH | SH |
| 27 | OH | H | H | SH |
| 28 | H | $C_5H_{11}$ | H | SH |
| 29 | SH | COOH | H | H |
| 30 | H | H | $SO_3H$ | SH |

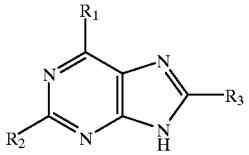

| | $R_1$ | $R_2$ | $R_3$ |
|---|---|---|---|
| 31 | SH | OH | H |
| 32 | SH | H | COOH |
| 33 | H | OH | SH |
| 34 | $SO_3H$ | SH | SH |
| 35 | H | SH | $SO_3H$ |
| 36 | $NH_2$ | H | SH |
| 37 | $NH_2$ | SH | H |
| 38 | H | $NH_2$ | SNa |
| 39 | SH | $NH_2$ | H |

40

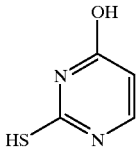

41

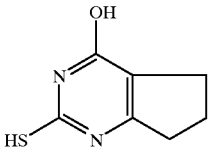

Using amount of the compound represented by the formula (2) is preferably $10^{-6}$ to $10^{-1}$ mole per liter of the washing water, more preferably $10^{-5}$ to $10^{-2}$ mole. It is preferable that the washing water contains at least one of salicylic acid, salicylic acid salts, salicylic acid derivatives, and salts of salicylic acid derivatives. In this case, the content of these compounds is preferably 0.2 to 20 g/l, more preferably 0.5 to 5 g/l.

The fixing solution according to the invention preferably includes a chelating agent of which chelate stabilization constant with calcium ion is 0.8 to 5.0. The chelate stabilization constant with calcium ion is a logarithm of chelate formation constant when one chelating agent bonds with one calcium ion, and measured at 20° C. under the condition of ion strength of 0.2. Concretely, examples of chelating agent are cited organic acids such as maleic acid, glycollic acid, gluconic acid, glucoheptanoic acid, tartaric acid, citric acid, succinic acid, salicylic acid, ascorbic acid and erythorbic acid, etc., and aminopolycarboxylic acids such as glycine, ethylenediaminetetraacetic acid, diethylenetriaminepentaacetic acid and nitrilotriacetic acid, and their derivatives and their salts. Among the aforesaid organic acids, gluconic acid and citric acid are preferable, among the aforesaid aminopolycarboxylic acids, ethylenediaminetetraacetic acid and diethylenetriaminepentaacetic acid are preferable.

Using amount of these compounds is 0.005 to 0.2 mole per liter of the fixing solution, preferably 0.005 to 0.1 mole.

In this invention, replenishing amount of the fixing replenishing solution is preferably 50 to 400 ml/$m^2$ of the light-sensitive material, preferably 80 to 250 ml. The replenishing amount means; (i) replenishing amount of the same solution as a mother solution in the tank in cases where the replenisher is made of the same solution as a mother solution in the tank, (ii) total amount of the volume of condensed processing solution and the volume of water in cases where the replenisher is made in the way in which the condensed processing solution is diluted with water, (iii) total amount of the volume of a solid processing composition and the volume of water in cases where the replenisher is made in the way in which the solid processing composition is diluted with water, (iv) total amount of the volume of a solid processing composition and the volume of water in cases where the solid processing composition and water are separately replenished.

As for a fixing solution and fixing replenishing solution, there are some types of fixing or fixing replenishing component including, one part type of fixing or fixing replenishing component in which one liquid composition or one solid composition is dissolved in water, and plural parts type of fixing or fixing replenishing component in which two or more liquid compositions or two or more solid compositions are dissolved in water. In cases where the liquid composition is dissolved, one part type of fixing or fixing replenishing component is preferably used because of easy handleability. In the processing method according to the invention, the fixing replenishment solution is preferably prepared by diluting a solid processing composition comprising at least one part molded in a solid form containing mixture of at least two components.

In this invention, the solid processing composition of the fixing replenishment solution is the solid processing composition in the form of a tablet, a pellet or granules, and optionally treated with moisture proof. The solution in the form of paste or slurry is in semi-liquid form and inferior in storage stability. Any form of the solid processing composition which is accompanied with a danger in transferring it and is regulated to transfer it is not allowed to be used in this invention.

The powder is referred to an aggregate comprised of fine crystal particles. The granules is referred to granular material prepared by subjecting the powder to granulating process, having particle sizes of 50–5000 $\mu$m. The tablet is one prepared by subjecting the powder or granules to compression-molding to a given form.

Among the above mentioned solid processing compositions, the tablet is preferably used because it is accurate in replenishment and handled easily.

The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer.

A preferred tablet-making process is to form a tablet by compression-molding after granulating powdery processing composition. As compared to a solid composition prepared simply by mixing the processing composition to form a tablet, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 $\mu$m and preferably 200 to 750 $\mu$m. In particular, 60% or more of the granules is with a deviation of ±100 to 150 $\mu$m. When the grain size smaller, it tends to cause localization of mixing elements and therefore, is undesirable. As hydraulic press machine, any conventional compression molding machine, such as a single-engined compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side.

It is further preferred to granulate separately each component, such as an alkali agent, reducing agent and preservative in the above-mentioned process.

The processing composition in the form of a tablet can be prepared according to methods, as described in JP-A 51-61837, 54-155038, 52-88025, and British Patent 1,213,808. The granular processing composition can also be prepared according to methods as described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

In cases where the solid processing composition of the invention is in the form of tablet, its bulk density is preferably 1.0 to 2.5 g/$cm^3$ from the viewpoint of solubility and the point of effects of the invention. When being not less than 1.0 g/$cm^3$, it is advantageous for strength of the solid composition; and when being not more than 2.5 g/$cm^3$, it is advantageous for solubility. In cases where the composition is in the form of granules or powder, the bulk density is preferably 0.40 to 0.95 g/$cm^3$.

The solid processing composition used in the invention is used for fixing agent but can be also used for other photographic processing agent such as rinsing agent. The developing agent and fixing agent can be excepted from the regulation of dangerous liquid.

It is the most preferable that whole components of the processing chemicals are solidified, but at least fixing chemicals and fixing replenishing chemicals to be solidified is preferred. That is, since there are many reactive chemicals which react each other and poisonous chemicals contained in the fixing components, the method according to the invention is remarkably effective. It is more preferable that the developing chemicals other than the fixing chemicals are solidified. Conventionally, these chemicals in the form of separatedly packed kits have met a problem because it is dangerous to transfer them.

With respect to a solid fixing composition used in the invention, it is included in the scope of the invention that only a part of the fixing chemicals is solidified. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

A preferable embodiment of a solid processing chemical applicable to the invention is that a fixing agent, a preserving agent, and a hardener such as an aluminum salt are solidified, and that, when a fixer is tableted, the numbers of the tablets may be not more than 4 tablets and, preferably, a single or two tablet(s). When the solid processing chemicals are solidified separately into not less than 2 tablets, it is preferable to pack these plural tablets or granules in the same package. Especially it is preferable that an aluminum salt is solidified from the viewpoint of handling.

As a package for the solid processing composition according to the invention, such a raw material as given below can be used, namely, polyethylene (including any one prepared in either a high-pressure method or a low-pressure method), polypropylene (either non-stretched or stretched), polyvinyl chloride, polyvinyl acetate, Nylon (either stretched or non-stretched), polyvinylidene chloride, polystyrene, polycarbonate, Vinylon, Evarl, polyethylene terephthalate (PET), other polyesters, rubber hydrochloride, an acrylonitrile-butadiene copolymer and an epoxy-phosphoric acid type resin (a polymer described in JP-A Nos. 63-63037/1988 and 57-32952/1982), or pulp.

The films of the above-given materials are usually made adhered to each other so as to be laminated. However, these materials may also be formed into a coated layer. It is further preferable to provide a gas-barrier layer thereto. For example, an aluminum foil or an aluminum vacuum-evaporated synthetic resin is sandwiched between the above-mentioned synthetic resin films.

A total oxygen permeability of the above-mentioned laminated layers is, preferably, not higher than 50 ml/m$^2$ 24 hr/atm (at 20° C. and 65% RH) and, more preferably, not higher than 30 ml/m$^2$ 24 hr/atm.

The total membrane thickness of these lamination layered membrane or single layered membrane is 1 to 3000 $\mu$m, preferably 10 to 2000 $\mu$m, more preferably 50 to 1000 $\mu$m.

A processing chemicals are packed, bound or covered with a water-soluble film or a binder. As a water-soluble film or a binder, are cited polyvinyl alcohol derivative, methylcellulose derivative, polyethyleneoxide derivative, starch derivative, polyvinyl pyrrolidone derivative, hydroxypropylcellulose derivative, pluran derivative, dextran derivative, acacia derivative, polyvinyl acetate derivative, hydroxyethylcellulose derivative, carboxyethylcellulose derivative, sodium carboxymethylhydroxyethylcellulose, poly(alkyl) oxazoline derivative and polyethyleneglycol. Among them, polyvinyl alcohol derivative and pluran derivative are preferably used from the viewpoint of covering or binding effect.

The membrane thickness of the above described water-soluble film is preferably 10 to 120 $\mu$m, taking account of storage stability of a solid processing composition, dissolving time of the water-soluble film and precipitation of crystals in an automatic processor, more preferably 15 to 80 $\mu$m, especially preferably 20 to 60 $\mu$m.

The water-soluble film is preferably heat plasticity. This is due to not only the easiness of heat seal treatment and ultrasonic deposition treatment but also effective covering.

The tensile strength of the water-soluble film is preferably 0.5×106 to 50×106 kg/m$^2$, more preferably 1×106 to 25×106 kg/m$^2$, especially preferably 1.5×106 to 10×106 kg/m$^2$. The tensile strength can be measured according to the method described in JIS Z-1521.

A photographic processing chemical packed, bound or covered by a water-soluble film or a binder is preferable to be packed in a moisture-resistive packaging material so as to be protected from a high moisture, a moisture in the air such as rain and mist, and an accidental damage produced by bringing the package into contacting with water by scattering water or by wet hand in the course of storing, transporting or handling the package. The moisture-resistive packaging materials include preferably a film having a thickness within the range of 10 to 150 $\mu$m. The material thereof is preferably at least a material selected from the group consisting of a polyolefin film such as those of polyethylene terephthalate, polyethylene and polypropylene, a sheet of craft paper capable of having a moisture-resistive effect displayable with polyethylene, waxed sheet of paper, moisture-resistive cellophane, glassine, polyester, polystyrene, polyvinyl chloride, polyvinylidene chloride, polyamide, polycarbonate, acrylonitrile and a metal foil such as those of aluminium, and a metallo-polymer. They may also be a compounded material of the above-given material.

In an embodiment of the invention, it is also preferable that a moisture-resistive material is made of a decomposable plastic including particularly a biodegradable or photolyzable plastic.

The biodegradable plastics include, for example, (1) those comprising a natural macromolecule, (2) a microbial growing polymer, (3) a synthetic polymer having a good biodegradation property, and (4) a compound of a biodegradable natural macromolecule to a plastic. The photolyzable plastics include, for example, (5) those having a group made present in the principal chain so as to be excited by UV rays and then coupled to a scission. Besides the above-given macromolecules, those having the two functions of a photolyzing and biodegrading properties at the same time may also effectively be used.

The typical and concrete examples thereof may be given as follows.

The examples of the biodegradable plastics may be given as follows;

(1) Natural macromolecules, namely, polysaccharide, cellulose, polylactic acid, chitin, chitosan, polyamino acid, and the modified thereof;

(2) Microbial growing polymers, namely,

"Biopol" comprising PHB-PHV (that is a copolymer of 3-hydroxybutylate and 3-hydroxybarrelate), and microbial growing cellulose;

(3) Biodegradable synthetic polymer, namely, polyvinyl alcohol, polycaprolactone and the copolymer or mixture thereof;

(4) Compound of a biodegradable natural macromolecule to a plastic, namely, natural macromolecule having a good biodegradation property such as starch and cellulose, which is added to a plastic so that a configuration decaying property can be provided to the plastic.

Photo-decomposable plastics, namely, (1) Those introduced thereinto with a carbonyl group for providing a photodecaying property those added thereto with a UV absorbent for accelerating a decaying property.

As for such a decomposable plastics as mentioned above, those publicly described in, for example, "Chemistry and Industry", Vol. 64, No. 10, pp. 478–484, (1990); "The Kino Zairyo", July, 1990 Issue, pp. 23–34; may be used. Besides the above, it is also allowed to use the decomposable plastics available on the market, such as Biopol (manufactured by I.C.I.), Eco (manufactured by Union Carbide Corp.), Ecolite (manufactured by Eco Plastics, Inc.), Ecostar (manufactured by St.Lawrence Starch Co.) and Nackle P (manufactured by Japan-Unicar, Inc.).

The above-mentioned moisture-proofed packaging materials are to have a moisture permeability coefficient of not higher than 10 g·mm/m$^2$·24 hr and, preferably not higher than 5 g·mm/m$^2$·24 hr.

The silver halide light-sensitive photographic material is usually subjected to process in a washing bath or in a stabilizing bath after fixing process. The stabilizing solution usually contains, for the purpose of stabilizing an produced image, an inorganic or organic acid or salt thereof for adjusting pH of the membrane (at pH 3–8 after processing), or an alkaline agent or a salt thereof, including, for example, boric acid, metaboric acid, borax, phosphates, carbonates, potassium hydroxide, sodium hydroxide, ammonia water, mono-carboxylic acids, dicarboxylic acids polycarboxylic acids, citric acid, oxalic acid, malic acid acetic acid, etc.; aldehydes such as formalin, glyoxal, glutaraldehyde, etc.; chelating agents such as ethylenediaminetetraacetic acid, or an alkali metal salt thereof, nitrilotriacetic acid, polyphosphates, etc.; antimolds such as phenol, 4-chlorophenol, cresol, o-phenylphenol, chlorophenol, dichlorophenol, formaldehyde, p-hydroxybenzoate, 2-(4-thiazoline)-benzimidazole, benzisothiazolin-3-one, dodecyl-benzyl-methylammonium chloride, N-(fluorodichloromethylthio)-phthalimide, 2,4,4'-trichloro-2'-hydroxydiphenyl ether, etc.; toning agents and/or residual color-improving agents such as nitrogen-containing heterocyclic compounds, including, for example, 2-mercapto-5-sodiumsulfonate-benzimidazole, 1-phenyl-5-mercapto tetrazole, 2-mercaptobenzothiazole, 2-mercapto-5-propyl-1, 3,4-triazole, 2-mercaptohypoxanthine, etc. Specifically, it is preferable that the stabilizing solution contains an antimold. These compounds may be replenished either in the form of a liquid or a solid.

In the processing method using the fixing chemicals according to the present invention by an automatic processor, pH of a used developing solition is 9.0 to 11.0, preferably 9.5 to 10.5.

There is no limitation to use a fixing agent used in a fixing solution according to the invention, but ammonium thiosulfate, sodium thiosulfate and ammonium sodium thiosulfate are preferably used, and the concentration of these fixing agents in a working solution is generally 0.7 to 1.5 mole/l. The fixing solution according to the invention contains a water-soluble aluminum salt which functions as a hardening agent, including, for example, an aluminum chloride, an aluminum sulfate, a potassium alum and an aluminum ammonium sulfate etc. The concentration of an aluminum ion in a working solution is preferably 0.01 to 0.15 mole/l. pH of the fixing solution is not lower than 4.0, preferably 4.7 to 5.5.

The fixing solution may contain, if necessary, a preserving agent (sulfite, metasulfite, etc.), a pH buffering agent (acetic acid, sodium carbonate, sodium hydrogencarbonate, sodium phosphate, sodium sulfite, etc.), a pH adjusting agent (sodium hydroxide, ammonia, sulfuric acid, etc.), a chelating agent capable of softening hard water, a compound described in JP-A 62-78551, a surfactant (an anion surfactant such as a sulfate compound, a sulfonate compound, etc., a polyethylene surfactant, an ampholytic surfactant described in JP-A 57-6840, a known defoaming agent, etc.), a wetting agent (an alkanolamine, an alkyleneglycol, etc.), a fixing accelerating agent (a thiosulfonic acid substituted by an alkyl and aryl group or it's salt, a thiourea derivative described in Japanese Patent Examined Publication Nos. 45-35754, 58-122535, 58-122536, an alcohol containing a triple bond in it's molecule, a thioether compound described in U.S. Pat. No. 4,126,459, a mesoion compound, an ammonium thiocyanate described in JP-A Nos. 64-4739, 1-4739, 1-159645, 3-101728).

The processing method according to the invention relates to a black-and-white silver halide photographic light-sensitive material used in the printing plate-making field and X-ray photographing field, but any known technique outside of the scope of the present invention is applicable to the present invention.

There is no limitation to use a developing agent used in a developing solution, but a dihyroxybenzene derivative, an ascorbic acid derivative and a ketogluconic acid derivative are preferably contained. Further, from the viewpoint of developability, it is preferred to use the dihyroxybenzene derivative and the ascorbic acid derivative in combination with a 1-phenyl-3-pyrazolidone derivative, or the dihyroxybenzene derivative and the ascorbic acid derivative in combination with a p-aminophenol derivative.

The method according to the present invention is especially effective in forming high contrast image whose γ is not less than 10 using later mentioned contrast increasing agent.

Next, preferable light-sensitive material according to the invention will be explained.

It is preferable that the light-sensitive material according to the invention contains a transition metal atom selected from of elements of VI group to X group of a periodic table in the silver halide emulsion layer. The transition metal selected from the elements of VI group to X group of a periodic table is introduced into the silver halide grain used in the invention in the form of complex. With respect to the transition metal complex, sexidentate metal complex represented by the following formula is preferred.

$$[ML_6]^m$$

wherein, M represents a transition metal selected from the elements of VI group to X group in a periodic table, L represents a ligand, m is 0, −1, −2, or −3. Examples of the ligand represented by L are nitrosyl, thionitorosyl, halogen (fluoride, chloride, bromide and iodide), cyanide, cyanate, thiocyanate, selenocyanate, tellurocyanate azido and aquo. The aquo preferably occupies one or two ligand(s). L may be the same or different.

Preferable examples of M are rhodium (Rh), ruthenium (Ru), rhenium (Re), osmium (Os) and iridium (Ir). Examples of the transition metal complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)_2]^{-}$
9 : $[Ru(NO)\ (H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$

18: $[Rh(NS)Cl_5]^{2-}$

19: $[Os(NO)Cl_5]^{2-}$

20: $[Cr(NO)Cl_5]^{2-}$

21: $[Re(NO)Cl_5]^{-}$

22: $[Os(NS)Cl_4(TeCN)]^{2-}$

23: $[Ru(NS)Cl_5]^{2-}$

24: $[Re(NS)Cl_4(SeCN)]^{2-}$

25: $[Os(NS)Cl(SCN)_4]^{2-}$

26: $[Ir(NO)Cl_5]^{2-}$

The metal complex can be added in the silver halide during preparing the silver halide grain. The metal complex may be added uniformly throughout the silver halide, or in the interior of the silver halide grain. The preferable transition metals according to the invention are Ru, Rh and Ir. These transition metals are preferably added during preparing the silver halide grain, but there is no limitation thereto. The added amount of these metal complexes is $10^{-8}$ to $10^{-3}$ mol per a mol of silver halide, preferably $10^{-8}$ to $10^{-6}$ mol.

It is preferable that the light-sensitive material according to the invention containing an organic high contrast increasing agent. As an organic high contrast increasing agent, is cited a nucleating compound performing nucleation development described in The Journal of Japanese Society of Printing Science and Technology 24, p.299(1987), or a compound performing selective development described in The Journal of Japanese Society of Printing Science and Technology 24, p.307(1987).

The exemplified compounds are cited hydrazine derivatives, 5 or 6-membered nitrogen containing heterocyclic compounds, and tetrazolium compounds, and these compounds are preferably used in combination with nucleation accelerating compounds.

An example of hydrazine derivative is represented by the following formula [H].

Formula [H]

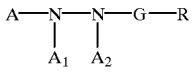

wherein A represents an aryl group or a heterocycle containing therein a sulfur atom or oxygen atom; G represents a $—(CO)_n—$ group, a sulfonyl group, a sulfoxy group, a $—P(=O)R_2$ group or an iminomethylene group, in which n is 1 or 2; $A_1$ or $A_2$ both represent hydrogen atoms, or one of $A_1$ and $A_2$ represents a hydrogen atom and the other represents a substituted or unsubstituted alkylsulfonyl group, or a substituted or unsubstituted acyl group; R represents a hydrogen atom, or an alkyl group, alkenyl group, aryl group, alkoxy group, alkenyloxy group, aryloxy group, heterocyclic oxy group, amino group, carbamoyl group or oxycarbonyl group, each of which may be substituted; and $R_2$ represents an alkyl group, alkenyl group, alkynyl group, aryl group, alkoxy group, alkenyloxy group, alkynyloxy group, aryloxy group, or amino group, each of which may be substituted.

In the present invention, as a hydrazine derivative, the compound represented by the above-mentioned general formula [H] is preferable and the compound represented by the following general formula [Ha] is particularly preferable.

Formula [Ha]

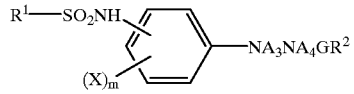

In the formula, $R^1$ represents an aliphatic group, for example, octyl group, decyl group, etc.; an aromatic group, for example, phenyl group, 2-hydroxylphenyl group, chlorophenyl group, etc.; or a heterocyclic group, for example, a pyridyl group, a thienyl group, a furyl group, etc.; and these groups may be substituted by an appropriate substituent. Further, it is also preferable that $R^1$ contains at least one ballast group or a silver halide adsorption-accelerating group.

As a diffusion-proof group, ballast groups which are commonly used in the immobile photographic additives such as couplers are preferable, and for such ballast groups, for example, an alkyl group, an alkenyl group, an alkynyl group, an alkoxy group, a phenyl group, a phenoxy group, an alkylphenoxy group, etc., which are relatively photographically inert consisting of carbon atoms of not less than 8, are cited.

The silver halide adsorption-accelerating agent includes, or example, a thiourea group, a thiourethane group, a mercapto group, a thioether group, a thione group, a heterocyclic group, a thioamide heterocyclic group, mercapto heterocyclic group, or those adsorbing groups disclosed in Japanese Patent O.P.I. Publication No.64-90439(1989), etc.

In the general formula [Ha], X represents a group which is capable of being a substituent on a phenyl group, m represents an integer of zero through four, provided when m is two or more, X may be the same or different.

In the formula [Ha], $A_3$ and $A_4$ independently have the same definition as $A_1$ and $A_2$ in the formula [H] respectively, it is preferable that both $A_3$ and $A_4$ are hydrogen.

In the formula [Ha], G represents a carbonyl group, a sulfonyl group, a sulfoxy group, a phosphoryl group or an iminomethylene group, and carbonyl group is preferable as G.

In the formula [Ha], $R^2$ represents a hydrogen atom, an alkyl group, an alkenyl group, an alkynyl group, an aryl group, a heterocyclic group, an alkoxy group, a hydroxy group, an amino group, a carbamoyl group and an oxy carbonyl group. The most preferable $R^2$s are $—COOR^3$ and $—CON(R^4)(R^5)$ group. $R^3$ represents an alkinyl group or a saturated heterocyclic group; $R^4$ represents a hydrogen atom, an alkyl group, an alkenyl group, an alkynyl group, an aryl group or a heterocyclic group; and $R^5$ represents an alkenyl group, an alkynyl group, a saturated heterocyclic group, a hydroxy group or an alkoxy group.

In the invention, the adding amount of the hydrazine derivative is usually within the range of $10^{-6}$ to $10^{-1}$ moles, preferably $10^{-5}$ to $10^{-2}$ moles, per mole of silver halide even though the optimum amount is varied depending on the diameter, halide composition, and the degree of chemical sensitization of silver halide grain, and the kind of stabilizing agent. The hydrazine derivative can be used singly or in combination.

The hydrazine derivative according to the invention may be contained in an optional layer of the silver halide light-sensitive material, from the viewpoint of the stability of the light-sensitive material, it is preferable that it is contained in a layer other than a silver halide emulsion layer.

5 to 6 membered nitrogen containing heterocyclic contrast increasing agent is shown below.

In the light-sensitive material according to the invention, using the nitrogen containing heterocyclic compounds represented by the following formula [Pa], [Pb] or [Pc] as a contrast increasing agent, it is possible to provide the image with preferred reservation stability, enhanced sensitivity, sufficient Dmax and excellent high contrast.

Formula (Pa)

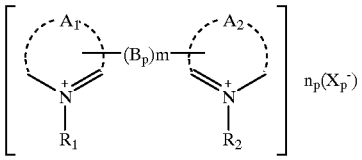

Formula (Pb)

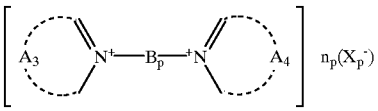

Formula (Pc)

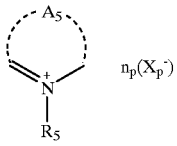

In the above described formula [Pa], [Pb] or [Pc], $A_1$, $A_2$, $A_3$, $A_4$ or $A_5$ represent non-metal atoms to complete 5 to 6 membered nitrogen containing heterocyclic ring, and said heterocyclic ring may contain oxygen atom, nitrogen atom and sulfur atom, and said heterocyclic ring may be condensed with benzene ring. The 5 to 6 membered nitrogen containing heterocyclic ring composed of $A_1$, $A_2$, $A_3$, $A_4$ or $A_5$ may be substituted by substituents. The examples of substituents are an alkyl group, an aryl group, an aralkyl group, an alkenyl group, an alkynyl group, a halogen atom, an acyl group, an alkoxycarbonyl group, an aryloxycarbonyl group, a sulfo group, a carboxy group, a hydroxy group, an alkoxy group, an aryloxy group, an amide group, a sulfamoyl group, a carbamoyl group, an ureido group, an amino group, a sulfonamide group, a sulfonyl group, a cyano group, a nitro group, a mercapto group, an alkylthio group and an arylthio group.

As the 5 to 6 membered nitrogen containing heterocyclic ring composed of $A_1$, $A_2$, $A_3$, $A_4$ or $A_5$ is cited pyridine, imidazole, thiazole, oxazole, pyrazine and pyrimidine, and preferable one is pyridine.

In the formula [Pa], [Pb], Bp represents divalent linking group. As the divalent linking group is cited alkylene, arylene, alkenylene, —$SO_2$—, —SO—, —O—, —S—, —CO—, and —N($R_6$)— ($R_6$ represent an alkyl group, an aryl group and a hydrogen atom), and these divalent linking group can be used singly or in combination of these groups arbitrarily selected. Preferable Bp is alkylene, alkenylene and alkyleneoxy, m is 0 or 1.

In the formula [Pa], [Pc], $R_1$, $R_2$ and $R_5$ each represents a saturated or an unsaturated alkyl group or aryl group having 1 to 20 carbon atoms, and these groups may be substituted by the same substituents as cited for $A_1$, $A_2$, $A_3$, $A_4$ or $A_5$.

Preferable examples for $R_1$, $R_2$ and $R_5$ are the alkyl group having 4 to 10 carbon atoms or the substituted or unsubstituted aryl group, and more preferable ones are the substituted or unsubstituted phenyl group, the unsaturated alkyl group or the alkyl group substituted by phenyl group.

In the formula [Pa], [Pb] or [Pc], $X_p^-$ represents a counter ion necessary to neutralize whole electric charge of the molecules, for example, chloride ion, bromide ion, iodide ion, nitric ion, sulfuric ion, p-toluenesulfonate and oxalate, $n_p$ represents number of counter ion necessary to neutralize whole electric charge of the molecules. In the case of internal salt, $n_p$ is 0.

As a tetrazolium compound, the compound represented by the following general Formula [T] is preferable.

Formula (T)

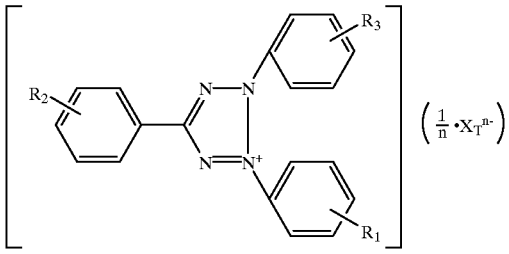

Each of $R_1$, $R_2$ and $R_3$ preferably represents a hydrogen atom or a group, of which Hamlett's σ-value showing degree of electron withdrawal is in the negative.

The σ values of the phenyl substituents are disclosed in lots of reference books. For example, a report by C. Hansch in "The Journal of Medical Chemistry", vol.20, on page 304(1977), etc. can be mentioned. Groups showing particularly preferable negative a-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), isopropyl group(−0.15), cyclobutyl group(−0.15), n-butyl group(−0.16), iso-butyl group(−0.20), n-pentyl group(−0.15), cyclohexyl group(−0.22), amino group(−0.66), acetylamino group(−0.15), hydroxyl group(−0.37), methoxy group(−0.27), ethoxy group(−0.24), propoxy group(−0.25), butoxy group(−0.32), pentoxy group(−0.34), etc. can be mentioned. All of these groups are useful as the substituent for the compound represented by the general formula [T] according to the present invention.

n represents 1 or 2, and as anions represented by $X^{n-}_T$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, specifically including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; boric acid-type anions such as tetraphenyl boron, etc.; dialkylsulfo succinate anions such as di-2-ethylhexylsulfo succinate anion, etc.; polyetheralcoholsulfuric acid ester anion such as cetyl polyethenoxy sulfate anion, etc.; higher aliphatic acid anions such as stearic acid anion, etc.; and those in which an anionic radical is attached to a polymer, such as polyacrylic acid anion, etc. can be mentioned.

Specific exemplified compounds represented by the general formula T are given. However, the scope of the present invention is not limited by these tetrazolium compounds.

| Compound No. | $R_1$ | $R_2$ | $R_3$ | $X_T^{n-}$ |
|---|---|---|---|---|
| T-1 | H | H | p—$CH_3$ | $Cl^-$ |
| T-2 | p—$CH_3$ | H | p—$CH_3$ | $Cl^-$ |
| T-3 | p—$CH_3$ | p—$CH_3$ | p—$CH_3$ | $Cl^-$ |
| T-4 | H | p—$CH_3$ | p—$CH_3$ | $Cl^-$ |
| T-5 | p—$OCH_3$ | p—$CH_3$ | p—$CH_3$ | $Cl^-$ |
| T-6 | p—$OCH_3$ | H | p—$CH_3$ | $Cl^-$ |
| T-7 | p—$OCH_3$ | H | p—$OCH_3$ | $Cl^-$ |
| T-8 | m—$C_2H_5$ | H | m—$C_2H_5$ | $Cl^-$ |
| T-9 | p—$C_2H_5$ | p—$C_2H_5$ | p—$C_2H_5$ | $Cl_-$ |
| T-10 | p—$C_3H_7$ | H | p—$C_3H_7$ | $Cl^-$ |
| T-11 | p—$isoC_3H_7$ | H | p—$isoC_3H_7$ | $Cl^-$ |
| T-12 | p—$OC_2H_5$ | H | p—$OC_2H_5$ | $Cl^-$ |
| T-13 | p—$OCH_3$ | H | p—$isoC_5H_7$ | $Cl^-$ |
| T-14 | H | H | p—$nC_{12}H_{25}$ | $Cl^-$ |
| T-15 | p—$nC_{12}H_{25}$ | H | p—$nC_{12}H_{25}$ | $Cl^-$ |
| T-16 | H | p—$NH_2$ | H | $Cl^-$ |
| T-17 | p—$NH_2$ | H | H | $Cl^-$ |
| T-18 | p—$CH_3$ | H | p—$CH_3$ | $ClO_4^-$ |

The above-mentioned tetrazolium compounds can be synthesized according to the method described on pages 335 through 483, vol. 55 of The Chemical Review.

The tetrazolium compound represented by the formula [T] may be used singly or in combination of not less than two kinds of them in any ratio.

These high contrast increasing agent may be used singly or in combination.

(Technology Used in Forming Image According to the Invention)

As a light source to expose, a tungsten lamp, a halogen lamp, a xenon lamp, a mercury lamp, CRT light source, FO-CRT light source, an emission diode and a laser beam (e.g., a gas laser, dye laser, YAG laser and semi-conductor laser etc.) is used either singly or in combination of two kinds or more. Furthermore, combined usage of a semi-conductor laser and SHG element (second high frequent wave emission element) is also employed. Among them a laser beam source is preferably used, and the laser beam source ranging 600–700 nm is especially preferred.

It is preferable to use the light-sensitive material containing the silver halide containing 60 mol % or more silver chloride. Concretely, silver chlorobromide or silver chloroiodobromide containing 60 mol % or more silver chloride is preferably used.

The average grain size of the silver halide is preferably 0.6 $\mu$m or less, and, more preferably 0.5 to 0.05 $\mu$m. The term "average grain size" has been used commonly in the art. The term "grain size" usually refers to a diameter of the grain, when the grain is of spherical shape or in the form close thereto. In the case when the grain is a cubic shape, it means a diameter of a sphere when the cube is converted into a sphere having the equivalent volume.

With regard to the method of obtaining the average diameter, one can refer to the disclosure on pages 36–43, third edition of "The theory of the photographic process" edited by C. E. Mees and T. H. James and published by Mcmillan Co. in 1966.

There is no limitation as to the shape of the silver halide grain, and any one of tabular, cubic, spheric, tetradeca hedral or octahedral shape can optionally be used. Concerning grain size distribution, the narrower, the more preferable. Particularly, so-called mono-dispersed emulsion, in which more than 90% (preferably 95%) of the total number of grains fall in the range ±40% around the average grain size, is preferable.

An emulsion composed of a tabular grain with not less than 90% of silver chloride having (100) face as the major face is preferred. Such the emulsion can be prepared by referring U.S. Pat. Nos. 5,264,337, 5,314,798 and 5,320,958.

A method for mixing soluble silver halide and soluble halogen salt in the invention may include any of a single-sided mixing method, a simultaneous mixing method a combination thereof. It is also possible to use a method (so-called reverse precipitation method) in which grains are formed under the condition of excessive silver ions. As a type of double-jet methods, it is possible to use a method to keep the pAg constant in a liquid phase in which silver halides are produced, namely the so-called controlled double jet method. Owing to this method, it is possible to obtain a silver halide emulsion in which crystal shapes are regular and grain diameters are almost uniform.

Gelatin is advantageously used as a binder or protective colloid of a photographic emulsion, but another hydrophilic colloid can be used. The examples of the hydrophilic colloid include gelatin derivatives, grafted gelatins with another polymer, proteins such as albumin or casein, cellulose derivatives such as hydroxycellulose, carboxymethylcellulose or cellulose sulfate, saccharides such as sodium alginate or starch derivatives and synthetic hydrophilic polymers such as polyvinyl alcohol, polyvinyl alcohol partial acetal, poly-N-vinyl pyrrolidone, polyacrylic acid, polymethacrylic acid, polyacryl amide, polyvinyl imidazole or polyvinyl pyrazole.

Gelatin includes limed gelatin, acid processed gelatin, gelatin hydrolysate or enzyme decomposed gelatin.

Other various additives are used for light-sensitive materials used in the invention. For example, desensitizer, plasticizer, lubricant, development accelerator, oil, nucleation accelerating agent and dye corresponding to an exposing light source are used.

With regard to s support used in the invention, a transmission type or a non-transmission type can be employed, but the transmission type of plastic support is preferable. The plastic supports include polyethylene compound (e.g., polyethylene terephthalate, polyethylene naphthalate), triacetate compound (e.g., triacetylcellulose), polystyrene (e.g., syndiotacticspolystyrene).

EXAMPLES

The present invention is explained with reference to examples below. However, the present invention is not limited to these examples.

Example 1

(Preparation of Silver Halide Emulsion)

Employing a double-jet method, an aqueous solution of silver nitrate and an aqueous solution of a mixture of NaCl and KBr were mixed to form silver halide grains containing 70 mol % of silver chloride and 30 mol % of silver bromide. The mixture was carried out under the condition including temperature of 50° C., pAg of 7.8 and pH of 3.0, and $2\times10^{-7}$ mol of a water-soluble rhodium salt per mol of silver was added in the course of grain formation. After that, employing a flocculation method, desalting was conducted by washing, then to this mixture were added a mixture of bactericides [A], [B] and [C] described below and ossein gelatin. Thus obtained mixture was redispersed. After redispersion, EAg was 220 mV. The emulsion thus obtained was one comprised of monodispersed cubic grains having an average grain diameter of 0.19 $\mu$m, of variation coefficient ((standard deviation of grain size/average grain size)×100) of 12%.

After pH and pAg of the emulsion thus obtained were each adjusted by citric acid and KBr respectively, to the resulting emulsion were added 5 mg chloroauric acid and 0.5 mg of flower of sulfur each per mol silver and the resulting emulsion subjected to chemical ripening at 53° C. for 50 min. After the chemical ripening, to the resulting emulsion was added 300 mg of 4-hydroxy-6-methyl-1,3,3a,7-tetrazaindene per mole of silver.

(Preparing Silver Halide Photographic Light-Sensitive Material)

On both sides of a polyethylene terephthalate substrate having a thickness of 100 $\mu$m were coated sublayers each of which was 0.1 $\mu$m thick. (referring to example 1 in JP-A No. 59-19941). On one side of the sublayers, the following layer compositions (1) to (3) were simultaneously coated in this order from the sublayer. On the other sublayer opposite to the above mentioned sublayer was coated a backing layer according to the following layer composition (4) in an amount of gelatin of 2.0 g/m$^2$, on which was coated a protective layer having following composition (5) in an amount of gelatin of 1.0 g/m$^2$. Thus a sample was obtained.

| Composition of hydrophilic colloidal layer (1) | |
|---|---|
| Gelatin | 0.6 g/m$^2$ |
| Surfactant: Saponin | 100 mg/m$^2$ |
| Dyestuff D-1 | 17 mg/m$^2$ |

| Composition of silver halide emulsion layer (2) | |
|---|---|
| Gelatin | 1.5 g/m$^2$ |
| Silver halide emulsion (An amount of silver) | 3.5 g/m$^2$ |
| Sensitizing dye Sd-1 | 0.5 mg/m$^2$ |
| Sensitizing dye Sd-2 | 0.5 mg/m$^2$ |
| Hydrazine derivative H-20 | $3 \times 10^{-5}$ mol/m$^2$ |
| Nucleation accelerating agent Na-12 | $1 \times 10^{-4}$ mol/m$^2$ |
| Polymer latex 1 | 0.5 g/m$^2$ |
| Colloidal silica | 0.25 g/m$^2$ |
| Hydroquinone | 50 mg/m$^2$ |
| Water-soluble polymer V-1 | 20 mg/m$^2$ |

-continued

| Composition of silver halide emulsion layer (2) | |
|---|---|
| Surfactants: | |
| Saponin: | 0.1 g/m$^2$ |
| Sodium iso-pentyl-n-decylsulfosuccinate | 8 mg/m$^2$ |

| Composition of protective layer protecting silver halide emulsion layer (3) | |
|---|---|
| Gelatin | 0.9 g/m$^2$ |
| Matting agent: Polymethylmethacrylate beads having an average particle diameter of 3.5 $\mu$m | 30 mg/m$^2$ |
| Surfactant: Sodium di-2-ethylhexylsulfosuccinate | 10 mg/m$^2$ |
| Surfactant: FA-1 | 0.6 mg/m$^2$ |
| Hardener: HA-1 | 150 mg/m$^2$ |

| Composition of backing layer (4) | |
|---|---|
| Gelatin | 2.0 g/m$^2$ |
| Surfactant: Saponin | 0.12 g/m$^2$ |
| Dyestuff D-2 | 18.9 mg/m$^2$ |
| Dyestuff D-3 | 67.2 mg/m$^2$ |
| Colloidal silica | 0.3 g/m$^2$ |
| Hardener: HA-1 | 110 mg/m$^2$ |
| Hardener: K | 110 mg/m$^2$ |

| Composition of protective layer protecting backing layer (5) | |
|---|---|
| Gelatin | 1.0 g/m$^2$ |
| Matting agent: Polymethylmethacrylate having an average particle diameter of 4.0 $\mu$m | 50 mg/m$^2$ |
| Surfactant: Sodium di-2-ethylhexylsulfosuccinate | 10 mg/m$^2$ |
| Hardener: HA-1 | 0.14 g/m$^2$ |
| Hardener: HA-3 | 100 mg/m$^2$ |

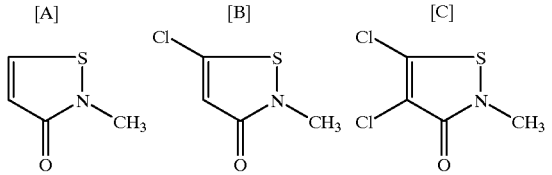

[A]: [B]: [C] = 46:50:4 (Mole ratio)

Sd-1

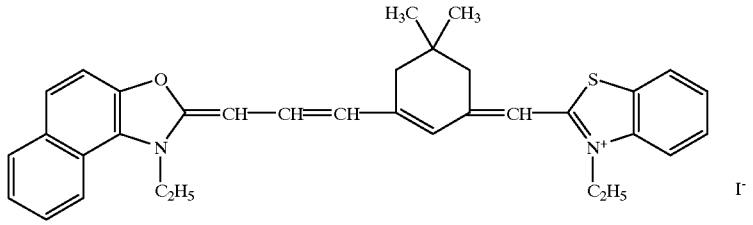

-continued
Sd-2
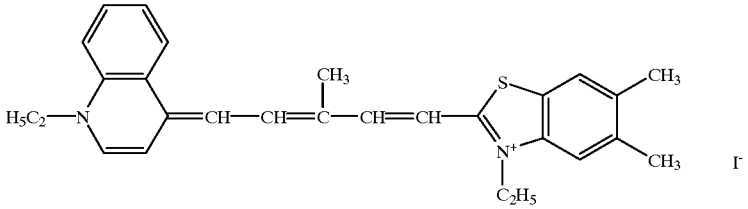
I
V-1
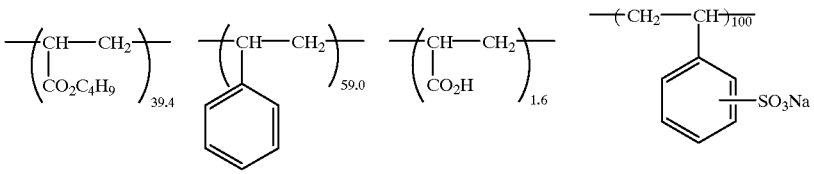
F-1
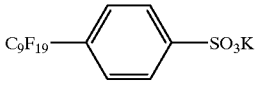
HA-1
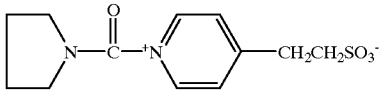
HA-2
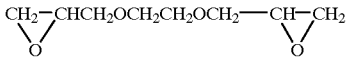
HA-3
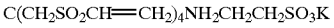
K
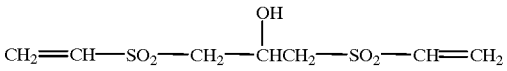
H-20
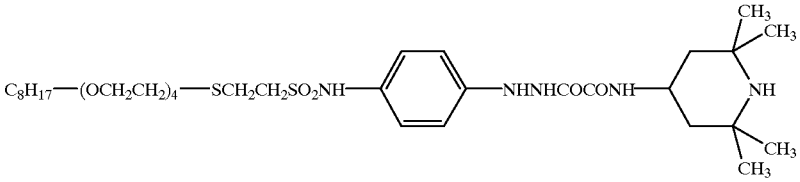
Na-12
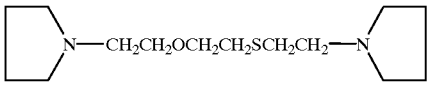
D-1
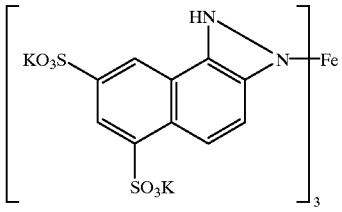
D-2
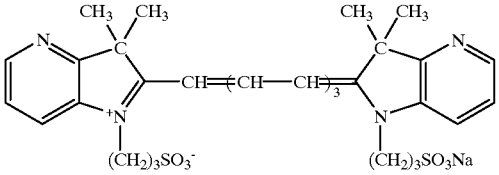
D-3
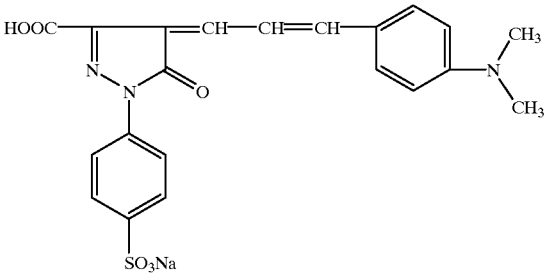

(Preparation of Processing Solutions)

| (1) Condensed developing solution (1 liter equivalent) | |
|---|---|
| Di-ethylenetriaminepentaacetic acid | 4 g |
| Sodium sulfite | 50.4 g |
| Potassium sulfite | 15.8 g |
| Potassium bromide | 5 g |
| Potassium carbonate | 40 g |
| Sodium carbonate | 14 g |
| Diethyleneglycol | 30 g |
| 8-mercaptoadenine | 0.2 g |
| Hydroquinone | 30 g |
| Sodium erythorbate | 5 g |
| 5-methylbeztriazole | 0.2 g |
| Dimezone S | 1.4 g |
| 1-phenyl-5-mercaptotetrazole | 0.04 g |

Water was added to make 333 ml, and the pH was adjusted to 10.6 with 48% of an aqueous KOH solution. Working solution was prepared with one part of the above mentioned condensed developer and two parts of water. The pH of thus obtained working solution was 10.40.

| (2) Condensed fixing solution according to the invention (1 liter equivalent) | |
|---|---|
| Pure water | 60 ml |
| Ammonium thiosulfate (20% Na salt: Produced by Hoechst Co., Ltd.) | 145 g |

-continued

| (2) Condensed fixing solution according to the invention (1 liter equivalent) | |
|---|---|
| Sodium sulfite | 25 g |
| Boric acid | amount shown in Table 2 |
| Precipitation restraining agent | amount shown in Table 2 |
| Sodium Acetate $3H_2O$ | 32 g |
| Tartaric acid | 5 g |
| Acetic acid (90% aqueous solution) | 16.5 g |
| Aluminum sulfate $18H_2O$ | 28 g |

50% aqueous sulfuric acid solution and pure water were added to make 400 ml. Working solution was prepared with two part of the above mentioned condensed fixer and three parts of water. The pH of thus obtained working solution was 4.7.

The above mentioned condensed developing solution and condensed fixing solution were each preserved under the condition of 50° C., 80% R.H. for 7 days, then each working solution was prepared.

(Preparation of Oxidizing Agent Kit (Condensed Solution))

| | |
|---|---|
| Pure water | 800 ml |
| Salicylic acid | 0.1 g |
| Hydrogen peroxide (35 wt % aqueous solution) | amount shown in Table 2 |
| Compound represented by Formula (1) | amount shown in Table 2 |

TABLE 2

| | Fixing agent kit | | | Oxidizing agent kit Hydrogen | Oxidizing agent kit | | | | | | |
|---|---|---|---|---|---|---|---|---|---|---|---|
| | Precipitation restraining agent | | Boric acid | peroxide (35 wt. %) | Compound of Formula (1) | | Compound of Formula (2) | | Chelating agent | | |
| Sample No. | Compound | Addition amount (g/l) | Addition amount (g/l) | Addition amount (g/l) | Compound | Addition amount (g/l) | Compound | Addition amount (mol/l) | Compound | Addition amount (g/l) | Remarks |
| 1 | — | — | 5 | — | — | — | — | — | — | — | Comp. |
| 2 | — | — | 10 | — | — | — | — | — | — | — | Comp. |
| 3 | — | — | 10 | 100 | — | — | — | — | — | — | Comp. |
| 4 | — | — | 10 | 171.5 | — | — | — | — | — | — | Comp. |
| 5 | — | — | 10 | 171.5 | Pluronic F-36 | 3.1 | 36 | $1 \times 10^{-3}$ | Ethylene-diaminete traacetic acid | $1 \times 10^{-2}$ | Comp. |
| 6 | Gluconic acid | $1 \times 10^{-2}$ | — | 171.5 | — | — | — | — | — | — | Inv. |
| 7 | Glycollic acid | $1 \times 10^{-2}$ | — | 171.5 | — | — | — | — | — | — | Inv. |
| 8 | Maleic acid | $1 \times 10^{-2}$ | — | 171.5 | — | — | — | — | — | — | Inv. |
| 9 | Imidinoacetic acid | $1 \times 10^{-2}$ | — | 171.5 | — | — | — | — | — | — | Inv. |
| 10 | 5-sulfosalicylic acid | $1 \times 10^{-2}$ | — | 171.5 | — | — | — | — | — | — | Inv. |
| 11 | Gluconic acid | $2 \times 10^{-2}$ | — | 171.5 | Pluronic F-36 | 1.5 | — | — | — | — | Inv. |
| 12 | Gluconic acid | $2 \times 10^{-2}$ | — | 171.5 | Pluronic F-36 | 3.1 | — | — | — | — | Inv. |
| 13 | Gluconic acid | $2 \times 10^{-2}$ | — | 171.5 | Pluronic F-36 | 3.1 | 36 | $1 \times 10^{-3}$ | — | — | Inv. |
| 14 | Gluconic acid | $2 \times 10^{-2}$ | — | 171.5 | Pluronic F-36 | 3.1 | 36 | $1 \times 10^{-3}$ | Ethylene-diaminete traacetic acid | $1 \times 10^{-2}$ | Inv. |
| 15 | Gluconic acid | $2 \times 10^{-2}$ | — | 171.5 | Pluronic | 3.1 | 36 | $1 \times 10^{-3}$ | Ethylene- | $1 \times 10^{-2}$ | Inv. |

TABLE 2-continued

| | Fixing agent kit | | | Oxidizing agent kit Hydrogen | Oxidizing agent kit | | | | | | |
|---|---|---|---|---|---|---|---|---|---|---|---|
| | Precipitation restraining agent | | Boric acid | peroxide (35 wt. %) | Compound of Formula (1) | | Compound of Formula (2) | | Chelating agent | | |
| Sample No. | Compound | Addition amount (g/l) | Addition amount (g/l) | Addition amount (g/l) | Compound | Addition amount (g/l) | Compound | Addition amount (mol/l) | Compound | Addition amount (g/l) | Re-marks |
| | | | | | F-36 | | | | triamine-penta-acetic acid | | |
| 16 | Gluconic acid | $2 \times 10^{-2}$ | — | — | — | — | — | — | — | — | Comp. |
| 17 | Gluconic acid | $2 \times 10^{-2}$ | — | — | Pluronic F-36 | 3.1 | 36 | $1 \times 10^{-3}$ | — | — | Comp. |
| 18 | Gluconic acid | $2 \times 10^{-2}$ | — | — | Pluronic F-36 | 3.1 | 36 | $1 \times 10^{-3}$ | Ethylene-diaminetetraacetic acid | $1 \times 10^{-2}$ | Comp. |
| 19 | — | — | 10 | — | — | — | — | — | — | — | Comp. |

Comp.: Comparison, Inv.: Invention (Running Process)

The above mentioned developing solution and fixing solution were each filled in processing tanks of LDT-1100 (automatic processor produced by Dainihon Screen Co., Ltd.) respectively. Replenishing amount of developing solution and fixing solution were each 130 ml/m$^2$ and 150 ml/m$^2$, and the above mentioned condensed oxidizing agent solution kit was diluted so as to prepare working solution (condensed oxidizing agent solution: water=1:100) which was filled in a washing tank. With respect to supplying oxidizing agent, every time one sheet of the light-sensitive material (610 mm×508 mm) was processed, 8 ml of the above mentioned condensed oxidizing agent solution was added in the washing tank, simultaneously 800 ml of water was added in the washing tank by reforming the automatic processor. By reforming driving system of the automatic processor, it could be possible to take developing time till 11 sec. Following processing condition was employed.

| | Processing condition | |
|---|---|---|
| | Temperature (° C.) | Processing time |
| Development | 35° C. | 12 sec. |
| Fixation | 33° C. | 12 sec. |
| Washing | 20° C. | 12 sec. |
| Drying | 45° C. | 12 sec. |
| Total | | 48 sec. |

200 sheets of the above prepared light-sensitive material (610 mm×508 mm) of which 50% of the area was exposed were processed regularly for 5 hours per a day for two days, after the automatic processor was run for one day, precipitation in the washing tank of the automatic processor and sliminess of roller were evaluated based on the following criteria. Further, 500 ml of washing water were poured into beakers and the beakers were allowed to stand open to atmosphere at 25° C. to check up days needed to fur.

(Evaluation of Precipitation in the Washing Tank of the Automatic Processor)

Rank 1: A large amount of precipitation was observed at the bottom of the washing tank of the automatic processor, and washing water became muddy in yellowish white color.

Rank 2: A medium amount of precipitation was observed at the bottom of the washing tank of the automatic processor, and washing water became muddy in white color.

Rank 3: A small amount of precipitation was observed at the bottom of the washing tank of the automatic processor, and washing water became muddy a little.

Rank 4: A very small amount of precipitation was confirmed by touching the bottom of the washing tank of the automatic processor by hand, and washing water was transparent.

Rank 5: No precipitation was the observed at the bottom of the washing tank of the automatic processor, and washing water was transparent.

(Evaluation of Roller Stain)

Rank 1: There was sliminess on overall roller, a large amount of stain was carried over to squeeze roller.

Rank 2: There was sliminess on overall roller, a small amount of stain was carried over to squeeze roller.

Rank 3: There was sliminess on the roller here and there, squeeze roller was not stained.

Rank 4: There was sliminess at the edge of roller.

Rank 5: There was no sliminess at all.

In the above mentioned both evaluation criteria, rank 3 or more is acceptable in practical use. In this evaluation, intermediate point such as 1.5, 2.5 and 4.5 was employed.

TABLE 3

| Sample No. | Washing roller stain Rank | Precipitation in washing tank Rank | Squeezing roller stain Rank | Days for furring Days | Remarks |
|---|---|---|---|---|---|
| 1 | 1 | 1 | 1 | 3 | Comp. |
| 2 | 1 | 1 | 1 | 3 | Comp. |
| 3 | 1.5 | 2 | 2 | 5 | Comp. |
| 4 | 2 | 2 | 2.5 | 6 | Comp. |
| 5 | 2 | 2.5 | 2.5 | 7 | Comp. |
| 6 | 4.5 | 4 | 4 | 45 | Inv. |
| 7 | 4 | 4 | 4 | 44 | Inv. |
| 8 | 4 | 4 | 4 | 45 | Inv. |
| 9 | 4.5 | 4 | 4 | 45 | Inv. |
| 10 | 4 | 4 | 4 | 45 | Inv. |
| 11 | 4.5 | 4.5 | 4 | 55 | Inv. |
| 12 | 4.5 | 4.5 | 4.5 | 68 | Inv. |

TABLE 3-continued

| Sample No. | Washing roller stain Rank | Precipitation in washing tank Rank | Squeezing roller stain Rank | Days for furring Days | Remarks |
|---|---|---|---|---|---|
| 13 | 4.5 | 5 | 4.5 | 85 | Inv. |
| 14 | 5 | 5 | 4.5 | 89 | Inv. |
| 15 | 5 | 5 | 5 | Over 90 | Inv. |
| 16 | 1 | 1.5 | 1.5 | 5 | Comp. |
| 17 | 1.5 | 1.5 | 2 | 5 | Comp. |
| 18 | 1.5 | 1.5 | 2.5 | 6 | Comp. |
| 19 | 1 | 1 | 1 | 2 | Comp. |

Comp.: Comparison,
Inv.: Invention

Example 2

Preparing a Solid Processing Composition

[Preparing a Solid Developer Kit (10 liter of Working Solution Equivalent)]

(Pulverizing Raw Materials)

Hydroquinone was pulverized by a pulverizer, MIKRO-PULVERIZER AP-B produced by Hosokawa Micron Co., Ltd. with a mesh of 8 mm and rotational rate of 25 Hz and 8-mercaptoadenine was similarly pulverized with the mesh of 8 mm and the rotational rate of 50 Hz. KBr was similarly pulverized with the mesh of 8 mm and the rotational rate of 50 Hz.

(Mixing Raw Materials)

The following composition was mixed for 10 minutes in a commercially available V-type mixing vessel.

(1 Liter of Working Solution Equivalent)

| | |
|---|---|
| Hydroquinone (pulverized mentioned above) | 24 g |
| Elbit N | 5 g |
| Demezone S | 1.3 g |
| 8-Mercaptoadenine (pulverized mentioned above) | 0.2 g |
| DTPA · 5Na | 4 g |
| KBr (pulverized mentioned above) | 2 g |
| Sorbitol | 1.8 g |

(Molding)

Thus obtained mixture was molded by compression granulator, briquetter BSS-IV produced by Shintokogyo Co., Ltd. with pocket form of 5.0 mmϕ×1.2 mm (Depth), roller rotational rate of 20 rpm and feeder rotational rate of 50 rpm. The obtained tabular form molded object was crushed by a classifier and divided into granule having particle diameter of 2.4 mm to 7.0 mm and fine powder having particle diameter of less than 2.4 mm. The granule having particle diameter of more than 7.0 mm was crushed again and the fine powder having particle diameter of less than 2.4 mm was mixed with the above mentioned mixture and returned to the compression granulator to be molded. Thus obtained granule is termed DA part.

(Preparing Raw Materials)

The following raw materials were prepared and pre-treated.

(Mixing Sodium Sulfite/1-phenyl-5-mercaptotetrazole/benzotriazole)

In 400 ml of ethyl alcohol (1.3 ml per liter of working solution), 18 g of 1-phenyl-5-mercaptotetrazole (0.06 g per liter of working solution) and 78 g of benzotriazole (0.26 g per liter of working solution) were dissolved. The obtained solution was poured little by little to 20 kg of sodium sulfite (66.67 g per liter of working solution) rotating in a mixer vessel and rotation was continued until the mixture was sufficiently dried up. By sampling arbitrarily each 10 g from 5 points of the obtained mixture and analyzing, it was found that 1-phenyl-5-mercaptotetrazole and benzotriazole were sufficiently mixed uniformly. The obtained mixture is termed DB part.

(Mixing Potassium Carbonate/Sodium Carbonate•Anhydride/Lithium Hydroxide•$1H_2O$)

56 kg of potassium carbonate (28 g per liter of working solution), 42 kg of sodium carbonate•(21 g per liter of working solution) and 22 kg of lithium hydroxide•$1H_2O$ (11 g per liter of working solution) were mixed for 10 minutes in a commercially available V-type mixing vessel (capacity of 200 1). The obtained mixture is termed DC part.

(Packing (10 Liter Working Solution Kit))

The mixtures of raw materials and molded product were filled up in the following order in standing pouch form and sealed up by a heat sealer.

| | | |
|---|---|---|
| Mixture DC part | 600 g | (undermost layer) |
| Mixture DB part | 670 g | (intermediate layer) |
| Granule DA part | 383 g | (uppermost layer) |

This kit was diluted in 10 liter of pure water.

[Preparing a Solid Fixer Kit (10 Liter of Working Solution Equivalent)]

(Pulverizing Raw Materials)

Sodium 1-octanesulfonate was pulverized by a pulverizer, MIKRO-PULVERIZER AP-B produced by Hosokawa Micron Co., Ltd. with the mesh of 4 mm and rotational rate of 60 Hz.

(Mixing Raw Materials)

The following composition was mixed for 10 minutes in the commercially available V-type mixing vessel (capacity of 200 l).

(1 Liter of Working Solution Equivalent)

| | |
|---|---|
| Ammonium thiosulfate (including 10% sodium salt) | 145 g |
| Sodium metabisulfite | 25 g |

1.6 g of sodium 1-octanesulfonate (pulverized mentioned above) was added to the above obtained mixture and thus obtained mixture was mixed still more for 5 minutes.

(Molding)

Thus obtained mixture was molded by the compression granulator, briquetter BSS-IV produced by Shintokogyo Co., Ltd. with pocket form of 5.0 mmϕ×1.2 mm (Depth), roller rotational rate of 30 rpm and feeder rotational rate of 67 rpm. The obtained tabular form molded object was crushed by a classifier and divided into granule having particle diameter of 2.4 mm to 7.0 mm and fine powder having particle diameter of less than 2.4 mm. The granule having particle diameter of more than 7.0 mm was crushed again and the fine powder having particle diameter of less than 2.4 mm was mixed with the above mentioned mixture and returned to the compression granulator to be molded. Thus obtained granule is termed FA part.

(Mixing Raw Materials)

Additionally, the following composition was mixed for 10 minutes by using commercially available V-type mixing vessel (capacity of 200 l).

| | |
|---|---|
| Sodium acetate · anhydride | 80 kg |
| Dehydrated aluminum sulfate | 19 kg |
| Precipitation restraining agent | amount shown in Table 4 |
| Tartaric acid | 3 kg |
| Boric acid | amount shown in Table 4 |

| | | |
|---|---|---|
| Granule FB | 620 g | (under layer) |
| Granule FA | 1610 g | (upper layer) |

Pure water was added to make 10 liters. pH was adjusted to 4.70 with 50% aqueous sulfuric acid solution and NaOH.

With respect to supplying method of oxidizing agent, the same method as carried out in example 1 was employed and the results obtained under the condition described in Table 4 were shown in Table 5.

TABLE 4

| | Fixing agent kit | | | Oxidizing agent kit Hydrogen peroxide (35 wt. %) | Oxidizing agent kit | | | | | | |
|---|---|---|---|---|---|---|---|---|---|---|---|
| | Precipitation restraining agent | | Boric acid | | Compound of Formula (1) | | Compound of Formula (2) | | Chelating agent | | |
| Sample No. | Compound | Addition amount (mol/l) | Addition amount (g/l) | Addition amount (g/l) | Compound | Addition amount (g/l) | Compound | Addition amount (mol/l) | Compound | Addition amount (mol/l) | Remarks |
| 1 | — | — | 5 | — | — | — | — | — | — | — | Comp. |
| 2 | — | — | 10 | — | — | — | — | — | — | — | Comp. |
| 3 | — | — | 10 | 100 | — | — | — | — | — | — | Comp. |
| 4 | — | — | 10 | 171.5 | — | — | — | — | — | — | Comp. |
| 5 | — | — | 10 | 171.5 | Pluronic F-36 | 3.1 | 36 | $1 \times 10^{-3}$ | Ethylene-diaminete traacetic acid | $1 \times 10^{-2}$ | Comp. |
| 6 | Gluconic acid | $1 \times 10^{-2}$ | — | 171.5 | — | — | — | — | — | — | Inv. |
| 7 | Glycollic acid | $1 \times 10^{-2}$ | — | 171.5 | — | — | — | — | — | — | Inv. |
| 8 | Maleic acid | $1 \times 10^{-2}$ | — | 171.5 | — | — | — | — | — | — | Inv. |
| 9 | Imidinoacetic acid | $1 \times 10^{-2}$ | — | 171.5 | — | — | — | — | — | — | Inv. |
| 10 | 5-sulfosalicylic acid | $1 \times 10^{-2}$ | — | 171.5 | — | — | — | — | — | — | Inv. |
| 11 | Gluconic acid | $2 \times 10^{-2}$ | — | 171.5 | Pluronic F-36 | 1.5 | — | — | — | — | Inv. |
| 12 | Gluconic acid | $2 \times 10^{-2}$ | — | 171.5 | Pluronic F-36 | 3.1 | — | — | — | — | Inv. |
| 13 | Gluconic acid | $2 \times 10^{-2}$ | — | 171.5 | Pluronic F-36 | 3.1 | 36 | $1 \times 10^{-3}$ | — | — | Inv. |
| 14 | Gluconic acid | $2 \times 10^{-2}$ | — | 171.5 | Pluronic F-36 | 3.1 | 36 | $1 \times 10^{-3}$ | Ethylene-diaminete traacetic acid | $1 \times 10^{-2}$ | Inv. |
| 15 | Gluconic acid | $2 \times 10^{-2}$ | — | 171.5 | Pluronic F-36 | 3.1 | 36 | $1 \times 10^{-3}$ | Ethylene-triamine-penta-acetic acid | $1 \times 10^{-2}$ | Inv. |

Comp.: Comparison, Inv.: Invention (Molding)

Thus obtained mixture was molded by the compression granulator, briquetter BSS-IV produced by Shintokogyo Co., Ltd. with pocket form of 5.0 mmϕ×1.2 mm (Depth), roller rotational rate of 30 rpm and feeder rotational rate of 67 rpm. The obtained tabular form molded object was crushed by a classifier and divided into granule having particle diameter of 2.4 mm to 7.0 mm and fine powder having particle diameter of less than 2.4 mm. The granule having particle diameter of more than 7.0 mm was crushed again and the fine powder having particle diameter of less than 2.4 mm was mixed with the above mentioned mixture and returned to the compression granulator to be molded. Thus obtained granule is termed FB part.

(Packing)

The molded products were filled up in the following order in standing pouch form.

TABLE 5

| Sample No. | Washing roller stain Rank | Precipitation in washing tank Rank | Squeezing roller stain Rank | Days for furring Days | Remarks |
|---|---|---|---|---|---|
| 1 | 1 | 1 | 1 | 3 | Comp. |
| 2 | 1 | 1 | 1 | 3 | Comp. |
| 3 | 1.5 | 2 | 2 | 5 | Comp. |
| 4 | 2 | 2 | 2.5 | 6 | Comp. |
| 5 | 2 | 2.5 | 2.5 | 7 | Comp. |
| 6 | 4.5 | 4 | 4 | 60 | Inv. |
| 7 | 4 | 4 | 4 | 63 | Inv. |
| 8 | 4 | 4 | 4 | 62 | Inv. |
| 9 | 4.5 | 4 | 4 | 66 | Inv. |
| 10 | 4 | 4 | 4 | 65 | Inv. |
| 11 | 4.5 | 4.5 | 4 | 86 | Inv. |
| 12 | 4.5 | 4.5 | 4.5 | 95 | Inv. |

TABLE 5-continued

| Sample No. | Washing roller stain Rank | Precipitation in washing tank Rank | Squeezing roller stain Rank | Days for furring Days | Remarks |
|---|---|---|---|---|---|
| 13 | 4.5 | 5 | 4.5 | 110 | Inv. |
| 14 | 5 | 5 | 4.5 | 130 | Inv. |
| 15 | 5 | 5 | 5 | Over 150 | Inv. |

Comp.: Comparison,
Inv.: Invention

Disclosed embodiment can be varied by a skilled person without departing from the spirit and scope of the invention.

What is claimed is:

1. A method for processing a black-and-white silver halide photographic light-sensitive material by an automatic processor comprising:

developing an exposed silver halide photographic light-sensitive material in a developing solution;

fixing said developed silver halide photographic light-sensitive material in a Fixing Solution containing a thiosulfate salt of 0.7 to 1.5 mol/l and an aluminum salt, wherein concentration of aluminum ion in said Fixing Solution is 0.01 to 0.15 mol/l;

washing said fixed silver halide photographic light-sensitive material in a washing water; and wherein concentration of a boron compound in said Fixing Solution is 0 to 0.04 mol/l, said Fixing Solution contains at least a precipitation restraining agent of 0.005 to 0.2 mol/l, and said washing water contains an oxidizing agent, wherein an amount of said oxidizing agent is 0.5 to 10 mol equivalent to an amount of said thiosulfate carried over into said washing water by said black-and-white silver halide photographic light-sensitive material.

2. The method for processing the silver halide photographic light-sensitive material of claim 1, wherein said washing water is made by mixing a solution containing said oxidizing agent or a solid composition containing said oxidizing agent with water.

3. The method for processing the silver halide photographic light-sensitive material of claim 2, wherein mixing said solution containing said oxidizing agent or said composition containing said oxidizing agent with water is carried out in a washing tank or a stabilizing tank of an automatic processor.

4. The method for processing the silver halide photographic light-sensitive material of claim 1, wherein said precipitation restraining agent includes at least one of gluconic acid, glycollic acid, maleic acid, imidinoacetic acid, and 5-sulfosalicylic acid, and their derivatives, and their salts, and salts of their derivatives.

5. The method for processing the silver halide photographic light-sensitive material of claim 1, wherein said oxidizing agent is hydrogen peroxide.

6. The method for processing the silver halide photographic light-sensitive material of claim 1, wherein replenishing solution of said fixing solution is replenished in an amount of not more than 400 ml/$m^2$.

7. The method for processing the silver halide photographic light-sensitive material of claim 1, wherein the replenishing solution of said fixing solution is prepared by dissolving a solid processing composition in water, comprising at least one part molded in a solid form containing a mixture of at least two components.

8. The method for processing the silver halide photographic light-sensitive material of claim 1, wherein said washing water contains bactericide.

9. The method for processing the silver halide photographic light-sensitive material of claim 1, wherein said washing water contains a compound represented by the following formula (1);

Formula (1)

$$HO—(C_2H_4O)n—(C_3H_6O)m—(C_2H_4O)l—H$$

n, m and l represent each a positive integer.

10. The method for processing the silver halide photographic light-sensitive material of claim 1, wherein said washing water contains at least one of salicylic acid, salicylic acid salt, derivative of salicylic acid and salt of the derivative of salicylic acid.

11. The method for processing the silver halide photographic light-sensitive material of claim 1, wherein said washing water contains silver sludge preventing compound represented by the following formula (2);

Formula (2)

$$Z^1—SM^1.$$

12. The method for processing the silver halide photographic light-sensitive material of claim 1, wherein said fixing solution contains chelating agent of which chelate stabilization constant with calcium ion is 0.8 to 5.0.

* * * * *